US006976497B2

(12) United States Patent
Gridley

(10) Patent No.: US 6,976,497 B2
(45) Date of Patent: Dec. 20, 2005

(54) PRESSURE-DIFFERENTIAL LIQUID RAISING SYSTEM

(76) Inventor: Brian J. Gridley, 11910 Clark Rd., Chardon, OH (US) 44024

( * ) Notice: Subject to any disclaimer, the term of this patent is extended or adjusted under 35 U.S.C. 154(b) by 48 days.

(21) Appl. No.: 10/671,819

(22) Filed: Sep. 26, 2003

(65) Prior Publication Data

US 2005/0067012 A1 Mar. 31, 2005

(51) Int. Cl.[7] ..... F04B 1/08; F04B 9/129

(52) U.S. Cl. ..... 137/14; 137/236.1; 137/206; 417/121; 417/137

(58) Field of Search ..... 137/14, 236.1, 137/206, 386, 403; 417/121, 137, 118, 120

(56) References Cited

U.S. PATENT DOCUMENTS

| | | | | |
|---|---|---|---|---|
| 1,625,519 A | | 4/1927 | Booth | |
| 2,131,183 A | | 9/1938 | Key | |
| 2,864,317 A | | 12/1958 | Robinson | |
| 3,736,983 A | | 6/1973 | Beard et al | |
| 3,829,246 A | | 8/1974 | Hancock | |
| 3,894,554 A | * | 7/1975 | Mangus et al. | 137/206 |
| 4,050,854 A | | 9/1977 | Hereford et al. | |
| 4,305,700 A | * | 12/1981 | Beard | 417/121 |
| 4,380,419 A | * | 4/1983 | Morton | 417/121 |
| 4,801,246 A | | 1/1989 | Baumberg | |

* cited by examiner

*Primary Examiner*—Kevin Lee
(74) *Attorney, Agent, or Firm*—Wilhelm Law Service; Thomas D. Wilhelm

(57) ABSTRACT

Liquid raising systems raise liquid from a system inlet to a system outlet without any moving parts below the system outlet. One or more closed cells are disposed at elevations between the system inlet and outlet. A liquid conduit leads from the bottom of each cell to the top of the next downstream cell. Gas pressure-differential between two next-adjacent cells causes liquid to flow through the liquid conduit to the next cell. The pressure-differential need be only enough to move the liquid between adjacent cells. The cells are cyclically filled and emptied by sequentially applying the gas at higher and lower pressures to adjacent cells, thus progressively moving liquid toward the system outlet. A cell can have a variety of shapes and sizes, so long as the cell gas inlet is above the liquid inlet, and the liquid outlet is below both the liquid inlet and the gas inlet.

54 Claims, 9 Drawing Sheets

PRESSURE-DIFFERENTIAL LIQUID RAISING SYSTEM

BACKGROUND

This invention pertains to fluid mechanics, and more particularly to apparatus for raising liquids such as water from a system inlet such as in a well at a lower elevation to a system outlet at a higher elevation such as above ground level without necessarily using any moving parts below ground level, alternatively in the in-ground portion of the system.

Normal atmospheric air pressure of approximately 14.7 pounds per square inch limits the distance by which water can be raised to ground level, by a conventional single-stage differential vacuum pump, to about thirty feet. Such use of differential vacuum can be thought of as the vacuum differential "pulling" the water upwardly, or by corollary by atmospheric pressure pushing the water upwardly under the counterbalance of a less-than-atmospheric/vacuum absolute pressure being developed by the pump. Consequently, for e.g. deep well applications, namely for any well over about 30 feet deep, where water is to be raised to the surface of the earth, e.g. ground level, according to conventional technology, a pump or pump part, such as a jet orifice, is located at or near the bottom of the well so the water or other liquid can be "pushed" upwardly.

Locating the pump or pump parts at or near the bottom of the well is accompanied by a number of disadvantages. Generally, it is preferable to locate the pump near or at the top of the well. For example, for maintenance, repair, or replacement of the pump or pump parts, it is desirable that all apparatus which may require periodic access, including all apparatus which incorporates therein moving parts, or wearing parts, to be positioned, sited for easy access, and not in the well, especially not near the bottom of the well. Further, in some well implementations, the presence of electricity in the well can be hazardous. Further, in some locations, electricity, or a chemical-reaction based engine or motor, for operating a mechanical pumping device may not be available; and operating power may be limited to manual operations.

The art does not teach or suggest liquid lifting apparatus adapted to lift liquid from a system inlet at e.g. a lower quiescent reservoir to an upper discharge locus at a system outlet, lifting the liquid, by pressure differential or vacuum differential of adjacent cells of the lifting apparatus, where all moving parts, or typically-replaced wear parts, can be at or above ground level, optionally at or adjacent the elevation of the system outlet.

Thus, it is an object of the invention to provide liquid raising systems which can operate at no more than atmospheric pressure differential while lifting the liquid a distance greater than the distance represented by a column of such liquid representing atmospheric pressure.

It is a further object to provide such liquid raising systems which have no moving parts below an operations level at e.g. ground level.

It is yet a further object to provide such liquid raising systems which operate by cycling pressure differential among respective next-adjacent cells in the liquid flow path, thus to move the liquid sequentially from cell to cell toward a destination reservoir.

It is a still further object to provide such systems wherein liquid-conveying conduits provide liquid communication between respective next adjacent cells, and wherein a portion of a respective such liquid-conveying conduit is at an elevation lower than the liquid outlet of the respective source cell.

It is still a further object to provide such systems wherein the portion of the liquid-conveying conduit, which is at the lower elevation, is greater than the height from the source cell liquid inlet to the top wall of the destination cell liquid outlet.

It is another object of the invention to provide liquid raising systems which can lift water to ground level from, for example and without limitation, at least 40 feet, preferably at least 70 feet depth, more preferably at least 100 feet depth, still more preferably at least 250 feet, or more, while employing no more than atmospheric pressure, and employing no moving parts in the in-ground assembly portion of a respective system.

It is still another object of the invention to provide liquid raising systems which can lift liquid such as water or oil to ground level from essentially any desired depth to which air pressure can be effectively pumped while employing cycling of air pressure in respective cells of the system, and while employing no moving parts in the in-ground assembly portion of the system.

SUMMARY

The invention generally comprehends liquid raising systems, sometimes called pumps, which are used to raise liquid from a first lower elevation to a second higher elevation. Liquid raising systems of the invention generally include an in-ground assembly which is free from parts which routinely require repair or maintenance during the normal use life of the system, and which is optionally free from moving parts. The system is designed to apply cycling pressure differentials in the in-ground assembly without use of moving parts in the in-ground assembly, and without use of any parts in the in-ground assembly which routinely require repair or maintenance. In general, liquid raising systems of the invention apply a pressure differential to a liquid cell in the in-ground system which causes liquid in the cell to move upwardly, in the downstream direction, while a nominal portion of the liquid in the respective cell moves upstream. Structure of the conduits between respective ones of the cells, or between a cell and the system inlet or system outlet each have a column which extends downwardly from the liquid source, namely from the system inlet or a cell, in the process of moving the liquid downstream toward the system outlet.

In a first family of embodiments, the invention comprehends a pressure-differential liquid raising system, comprising a system inlet at a first elevation for receiving liquid; a system outlet at a second elevation higher than the first elevation; at least one cell at a third intermediate elevation between the first and second elevations, the at least one cell having a cell liquid inlet and a cell liquid outlet; and a first liquid-conveying conduit having a first conduit liquid inlet in common with the system inlet at the first elevation, and a first conduit liquid outlet in a respective first cell at a third elevation, corresponding to a first liquid inlet of the respective first cell, the third elevation being higher than the first elevation of the first conduit liquid inlet. The system further has a second liquid-conveying conduit having a second conduit liquid inlet in common with a second liquid outlet of the first cell, and a second conduit liquid outlet at a higher fourth elevation than the second conduit liquid inlet; and pressure differential apparatus adapted to supply a first pressure differential between the system inlet and the first cell, thereby to cause liquid at the system inlet to flow through the first liquid-conveying conduit to the first cell, the pressure differential apparatus being further adapted to apply a second different pressure differential between the first cell and one of a downstream cell and the system outlet, and to simultaneously apply the second pressure differential between the first cell and the system inlet thereby to cause liquid from the first cell to flow in the downstream direction through the second liquid-conveying conduit along a liquid flow path toward the system outlet as well as to cause a nominal amount of the liquid to flow from the first cell upstream toward the system inlet.

In preferred embodiments, liquid is raised from a source reservoir at the system inlet and flows in a downstream direction through the first cell in response to cyclically applying the first and second pressure differentials.

In preferred embodiments, the first liquid-conveying conduit comprises first and second liquid-conveying columns in liquid communication with each other and which collectively define a liquid flow path, and wherein a portion of the liquid flow path is disposed at a lower elevation than the system inlet.

In further preferred embodiments, the system further comprises multiple substantially closed vertically-adjacent upstream and downstream cells at respective intermediate elevations between the system inlet and the system outlet, and corresponding multiple liquid-conveying conduits between vertically-adjacent upstream and downstream ones of the cells. Each of the corresponding multiple liquid-conveying conduits has a liquid inlet in the respective vertically-adjacent upstream cell and a liquid outlet in the respective vertically-adjacent downstream cell.

Further to preferred embodiments, the system further comprises a source reservoir which is substantially closed to casual ambient air pressure.

In especially preferred embodiments, the liquid flow path extends downwardly from the system inlet along the first column, and upwardly along the second column to the first conduit liquid outlet.

Further to preferred embodiments, the system further comprises a destination reservoir for receiving liquid from the system outlet, the destination reservoir optionally being substantially closed to casual ambient air pressure.

In especially preferred embodiments, the first and second liquid-conveying conduits are free from structure which would substantially impede, optionally structure which would stop, flow of liquid therein.

In some embodiments, the liquid in the second liquid-conveying column of the first liquid-conveying conduit is at a lower elevation than the liquid in the first liquid-conveying column of the first liquid-conveying conduit in response to applying the second pressure differential to the respective cell, but wherein the liquid in the first liquid-conveying conduit prevents air in the respective cell from passing upstream in the liquid flow path beyond the first liquid-conveying conduit and thus the first liquid-conveying conduit acts as a fluid check valve.

In preferred embodiments, the liquid raising system comprises an in-ground assembly for installation below ground level "G", the in-ground assembly being free from parts which require routine repair or maintenance, and optionally free from moving parts.

In a second family of embodiments, the invention comprehends a pressure-differential liquid raising system, for moving liquid, from a first elevation, to a second elevation higher than the first elevation. The system comprises a system inlet at the first elevation; a system outlet at the second elevation; at least one cell between the system inlet and the system outlet; a first liquid-conveying conduit having a first conduit liquid inlet in common with the system inlet, and a first conduit liquid outlet in a respective first cell at a first elevation, and first and second liquid-conveying columns, portions of each of the first and second liquid-conveying columns being at lower elevations than the system inlet; a second liquid-conveying conduit having a second conduit liquid inlet in common with a first liquid outlet of the first cell, and a second conduit liquid outlet above a floor of the first cell; and pressure differential apparatus adapted to supply pressure differentials between the system inlet and the first cell, thereby to cause liquid at the system inlet to flow in a downstream direction from the system inlet through the first liquid-conveying conduit to the first cell, and to cause the liquid to flow in the downstream direction from the first cell.

In some embodiments, the pressure-differential liquid raising system is adapted to cyclically apply a second pressure differential between the respective one of a downstream cell and the system outlet.

In some embodiments, at least one of the first and second liquid-conveying conduits is free from structure which would substantially restrict flow of liquid, optionally stop flow of liquid, in the respective liquid-conveying conduit.

In some embodiments, the system further comprises a destination reservoir which is a substantially closed container.

In some embodiments, the first liquid-conveying conduit comprises first and second columns in liquid communication with each other and which collectively define a liquid-conveyance path, and wherein the liquid is at first and second different elevations in the first and second columns in response to applying the second pressure differential to the respective cell.

The invention comprehends systems of the invention installed in the ground and reaching into an underground source reservoir of liquid, wherein the underground source reservoir is defined by underground geological structures.

In a third family of embodiments, the invention comprehends a pressure-differential liquid raising system, for moving liquid from a first elevation to a second elevation higher than the first elevation. The system comprises a system inlet at the first elevation; a system outlet at the second elevation; at least one cell between the system inlet and the system outlet; a liquid-conveying conduit having a first conduit liquid inlet in common with a first liquid outlet of a first cell inlet, and a first conduit liquid outlet in a respective second cell at a first elevation, and first and second liquid-conveying columns, portions of each of the first and second liquid-conveying columns being at lower elevations than the first liquid conduit inlet; a second liquid-conveying conduit having a second conduit liquid inlet in common with a second liquid outlet of the respective second cell, and a second conduit liquid outlet above a floor of the respective second cell; and pressure differential apparatus adapted to supply pressure differentials between the first cell and the second cell.

In a fourth family of embodiments, the invention comprehends a pressure differential liquid raising system, comprising a system inlet at a first elevation for receiving liquid; a system outlet at a second elevation higher than the first elevation; a plurality of cells at intermediate elevations between the first and second elevations, each cell having a top wall, a floor, a cell liquid inlet, a cell liquid outlet, and a gas port; liquid-conveying conduits connecting next vertically adjacent ones of the cells to each other at conduit liquid inlets at upstream ones of the adjacent cells and conduit outlets at the relatively downstream ones of the cells. Each liquid-conveying conduit has a downwardly extending column at an upstream end of the conduit, extending downwardly to an elevation below the floor of the respective cell whereby a portion of the respective liquid-conveying conduit is at an elevation lower than the lowest component of the respective cell. The system further comprises pressure differential apparatus adapted to supply pressure differentials between respective ones of the cells.

In preferred embodiments, the height of the portion of a respective conduit which is below the floor of the respective cell is greater than the height from the cell liquid inlet to the top wall of the next adjacent downstream cell.

Also in preferred embodiments, the height of the portion of a respective conduit which is below the floor of the respective cell is greater than the height between the floor of the respective cell and the top wall of the next vertically-adjacent cell.

In a fifth family of embodiments the invention comprehends a pressure differential liquid raising system, which comprises an in-ground assembly and an above-ground assembly. The in-ground assembly comprises a system inlet, at least one in-ground cell, having a top wall, and a floor, and liquid-conveying conduits adapted to convey the liquid to and through the at least one in-ground cell. The above-ground assembly comprises a system outlet at a destination reservoir adapted to receive liquid raised through the at least one cell, a pressure differential source, and pressure control apparatus for cycling the pressure differential between the respective cells, between a most downstream one of the cells and the destination reservoir, and between a most upstream one of the cells and a source reservoir. The in-ground assembly is free from parts which routinely require repair or maintenance.

In preferred embodiments, the in-ground assembly further comprises multiple vertically-adjacent upstream and downstream ones of the cells, and corresponding multiple liquid-conveying conduits between vertically adjacent upstream and downstream ones of the cells. Each of the corresponding multiple liquid-conveying conduits has a liquid inlet in the respective vertically-adjacent upstream cell and a liquid outlet in the respective vertically-adjacent downstream cell.

A further family of embodiments comprehends a method of raising liquid from a system inlet at a first elevation to a system outlet at a second elevation higher than the first elevation. The method comprises providing at least one cell at an intermediate elevation between the first and second elevations; applying a first pressure differential between one of (i) the system inlet and a first one of the respective cells, (ii) first and second ones of the cells, and (iii) one of the cells and the system outlet, and thereby causing the liquid to flow downwardly from the respective one of the system inlet and a respective one of the cells in a downstream direction to a third elevation lower than the first elevation, and subsequently causing the liquid to flow in the downstream direction and upwardly and to the respective first one of the cells, the second one of the cells, and the system outlet; and applying a second pressure differential between the respective cell and one of a second cell and the system outlet and thereby causing the liquid to flow from the respective cell in the downstream direction and toward the system outlet at the second elevation.

The method preferably includes causing the liquid to flow into the respective cell at a fourth elevation, and wherein causing the liquid to flow from the respective cell comprises causing the liquid to flow from the respective cell at a fifth elevation lower than the fourth elevation.

The method typically comprises conveying the liquid through a sufficient number of cells, at sufficient pressure differential between the cells, to lift the liquid at least 40 feet, optionally at least 70 feet, optionally at least 100 feet, in elevation.

The method also comprehends drawing liquid, e.g. water, oil, or other geologically-occurring liquid, into the system at the system inlet from an underground inlet reservoir of such liquid wherein the reservoir is defined by underground geological structure.

The invention also comprehends a method of raising liquid from a system inlet at a first elevation to a system outlet at a second elevation higher than the first elevation, wherein the method comprises providing an in-ground assembly and an above-ground assembly. The in-ground assembly comprises a system inlet, at least one in-ground cell, having a top wall and a floor, and liquid-conveying conduits adapted to convey the liquid to and through the at least one in-ground cell. The above-ground assembly comprises a system outlet at a destination reservoir adapted to receive liquid raised through the cells, a pressure differential source, and pressure control apparatus. The method further comprises applying cyclic sequential pressure differentials to the in-ground assembly thus to cause liquid to flow from the system inlet to the system outlet without use, in the in-ground assembly, of parts which require routine repair or maintenance.

In preferred embodiments, the method includes causing liquid to flow, from a respective cell, downwardly below the floor of the cell and thence upwardly to a next vertically-adjacent cell.

Also in preferred embodiments, the height of the downward flow is sufficiently great to prevent back flow of air into the respective cell, from the next vertically-adjacent downstream cell when the pressure differential is reversed, and wherein the pressure differential is no greater than standard atmospheric pressure.

The method preferably comprises conveying the liquid through a sufficient number of cells, at sufficient pressure differential between the cells, to lift the liquid at least 40 feet, optionally at least 70 feet, also optionally at least 100 feet, in elevation.

DESCRIPTION OF THE ILLUSTRATED EMBODIMENTS

Figure 1:
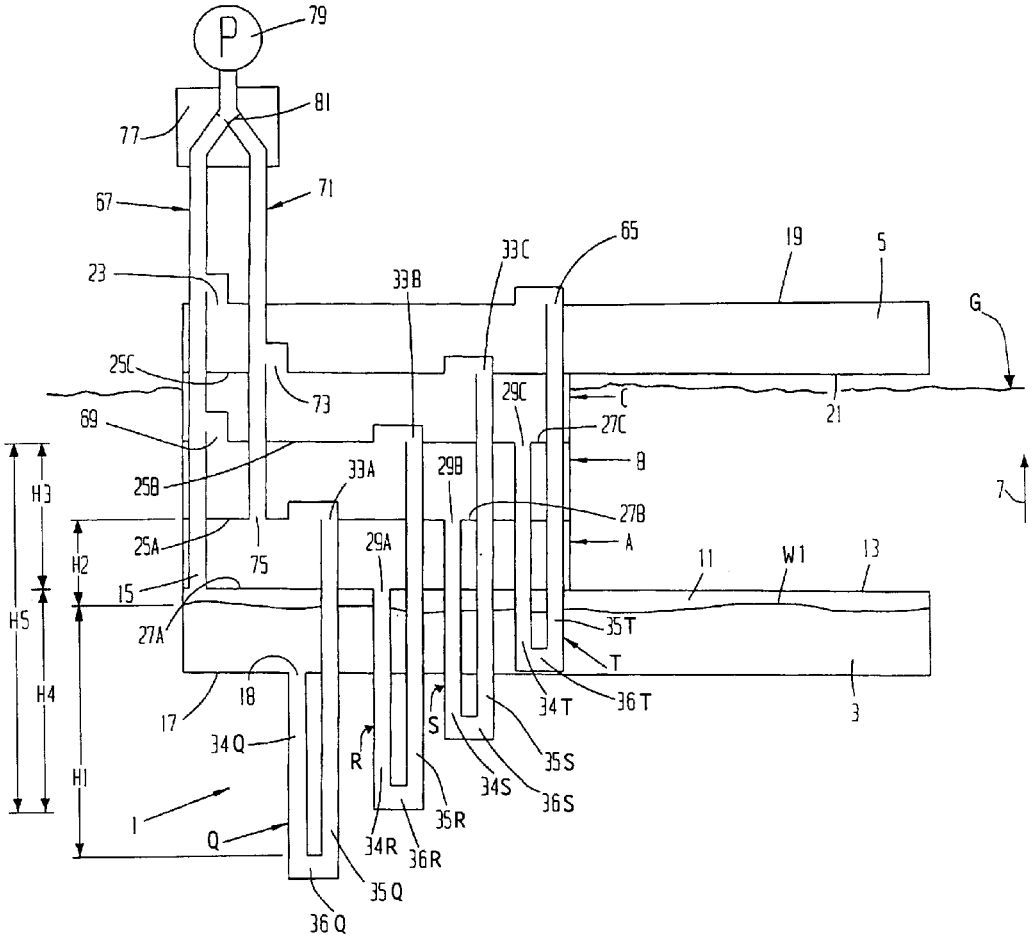
FIG. 1 is a schematic elevation diagram of a preferred embodiment of the pressure-differential liquid raising system of the present invention.

FIG. 1 illustrates a pressure-differential liquid raising system 1 of the invention.

The function of the pressure-differential liquid raising system 1 is to raise a liquid, such as water, from a system inlet at a source or source reservoir 3 to a discharge locus such as a system outlet at a destination reservoir 5, where the discharge locus/system outlet is at a higher elevation than the system inlet in the source reservoir. The pressure-differential liquid raising system raises the liquid without requiring any moving parts below the elevation of the system outlet, namely no moving parts below ground level "G", and raises the liquid by using only a gas, such as air, at a low pressure to effect movement/lifting of the liquid. Gases other than air can be used, but air is typically most cost effective, and thus is preferred.

The configuration of the particular pressure-differential liquid raising system 1 shown is merely representative of a wide variety of configurations by which the system can be implemented. It will be understood that pressure-differential liquid raising systems of the invention are capable of successfully raising liquids regardless of the particular system configuration used so long as the principles disclosed herein are employed.

Figure 7:
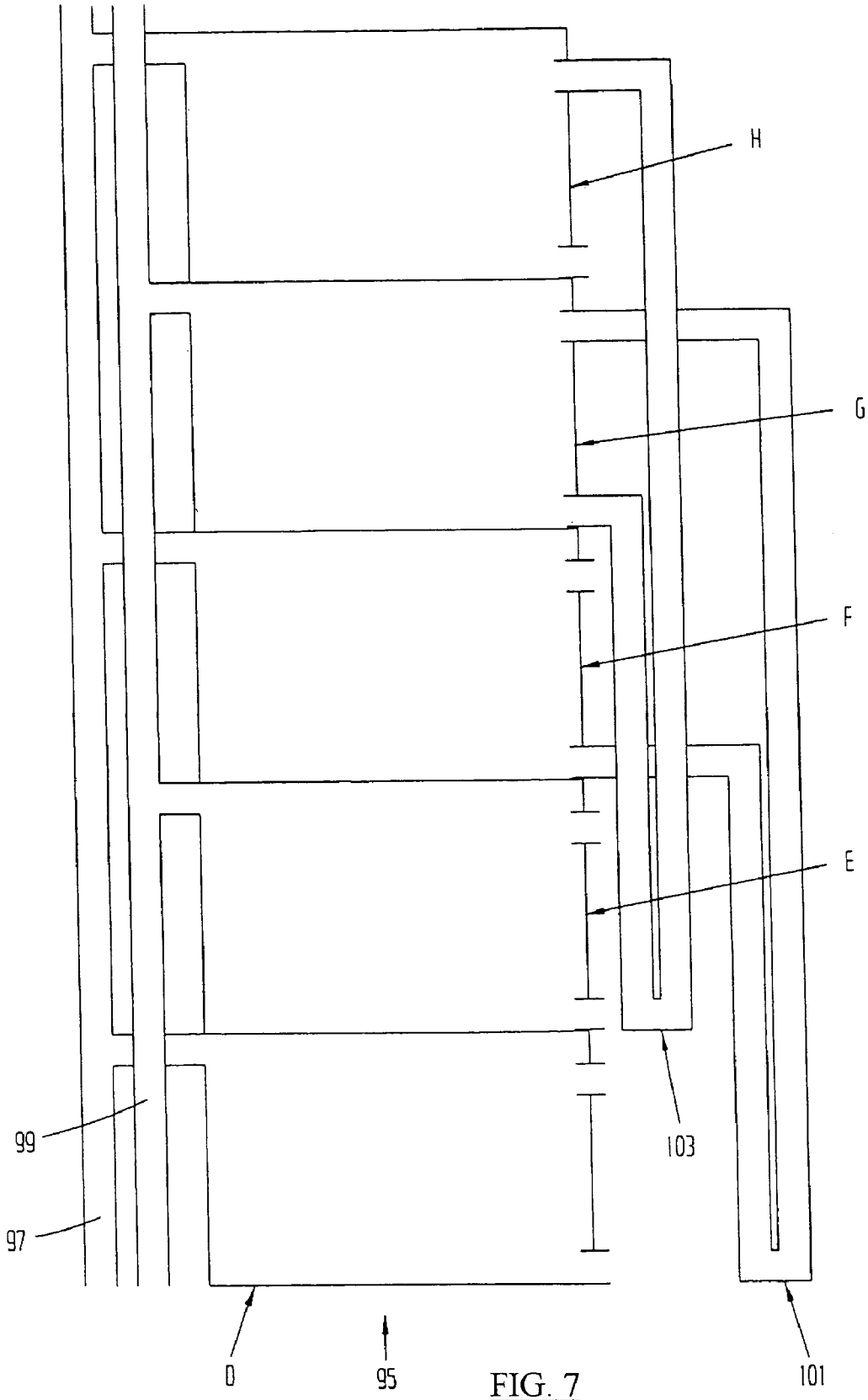
FIG. 7 is a schematic diagram of a second embodiment of the invention.
Figure 8:
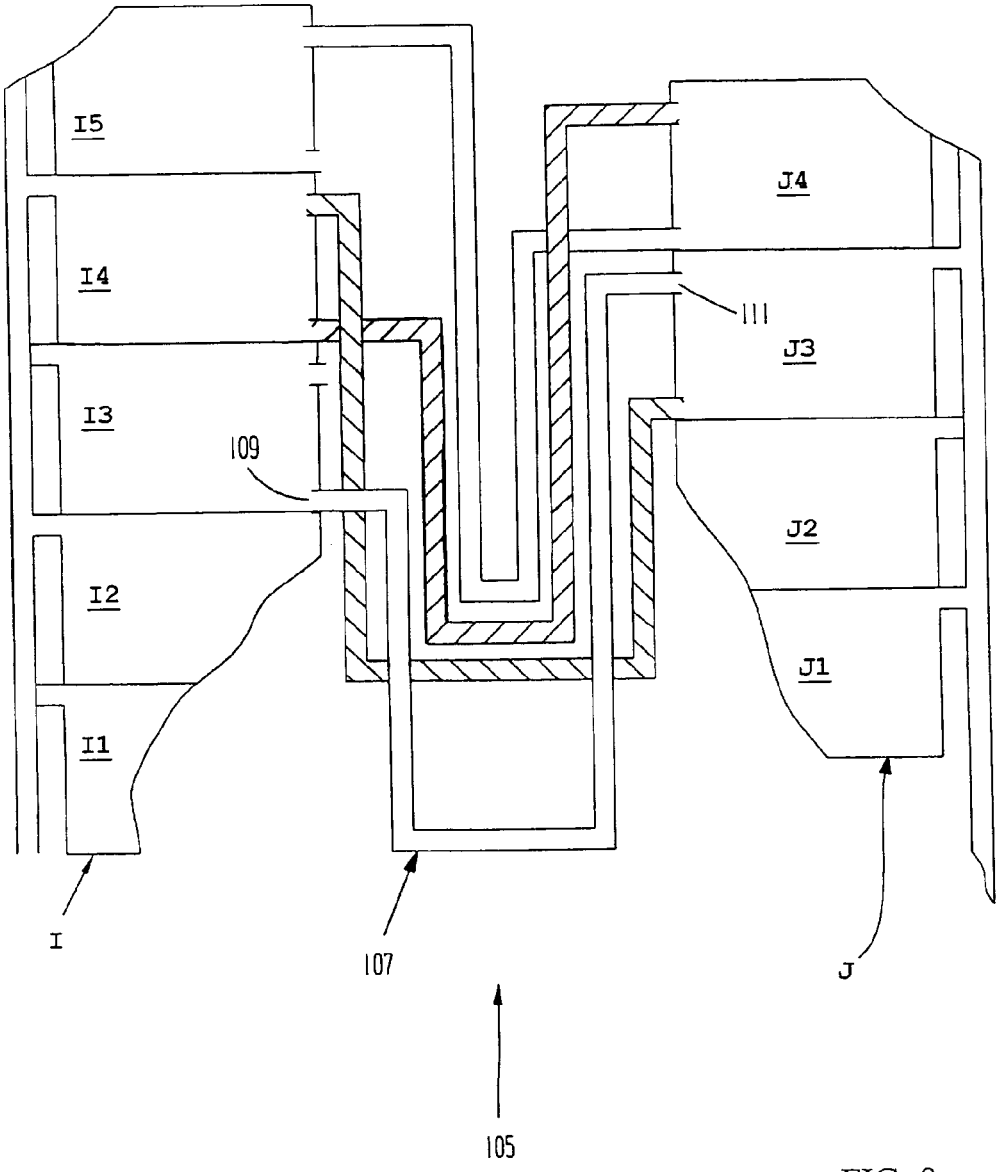
FIG. 8 is a schematic diagram of a third embodiment of the invention.
Figure 9E:
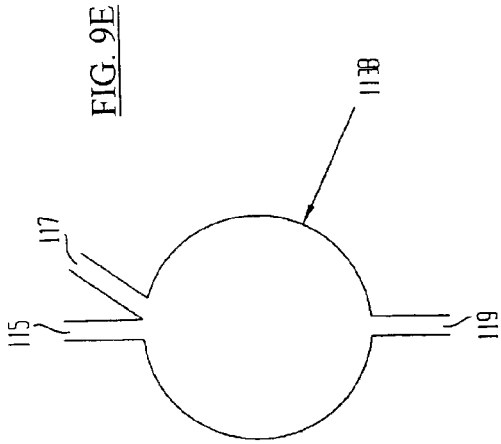
FIGS. 9A–9E show representative and exemplary shapes of various receptacles which can define the cells.
Figure 9D:
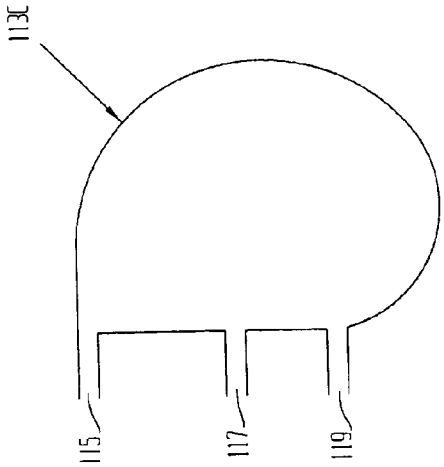
Figure 9C:
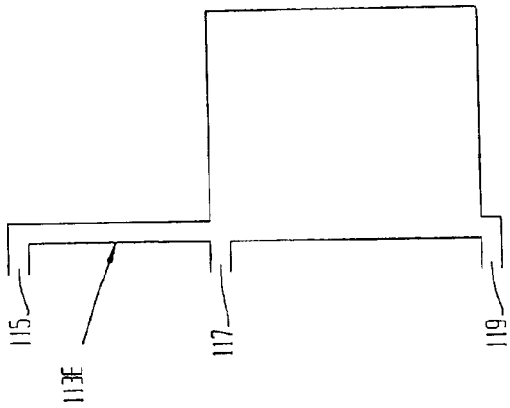
Figure 9A:
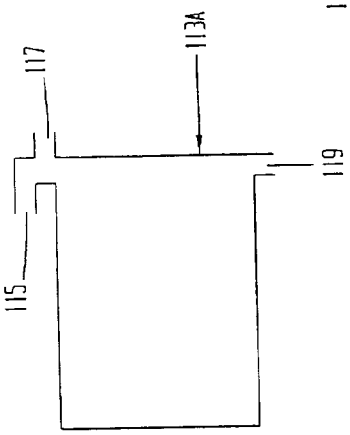
Figure 9B:
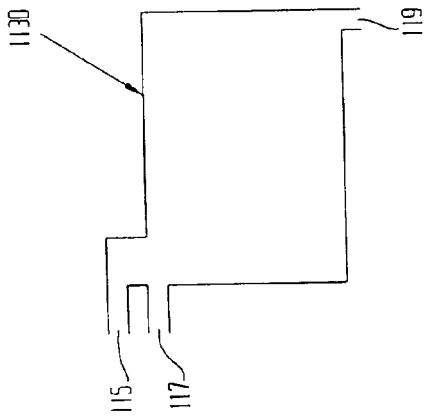

A plurality of operating cells are located between system inlet 18 and the system outlet 65. The system illustrated in FIGS. 1–6 shows three cells, namely cell A, cell B, and cell C. The system illustrated in FIG. 7 shows 5 cells, namely cell D, cell E, cell F, cell G, and cell H. The system illustrated in FIG. 8 shows 9 cells.

Referring to FIGS. 1–6, water from source reservoir 3 flows in a downstream direction 7 to and through cell A, from cell A to cell B, from cell B to cell C, and from cell C to the system outlet 65 at destination reservoir 5. The water can be released from destination reservoir 5 through appropriately-controlled valves (not shown). As illustrated, destination reservoir 5 and system outlet 65 are at higher vertical elevations than the system inlet 18 and source reservoir 3. Cell A is at a higher elevation than system inlet 18 and the upper level W1 of the water in source reservoir 3. Cell B is at a generally higher elevation than cell A. Cell C is at a generally higher elevation than cell B. System outlet 65 and destination reservoir 5 are at generally higher elevations than cell C. For convenience of illustration, the general overall direction of flow of water is designated as being in the downstream direction 7 even though the water is actually flowing from a lower elevation to a higher elevation, and even though the water flow path includes downward segments as the water leaves source reservoir 3 and each of the cells.

Source reservoir 3 has an upper water level W1 spaced by an air pocket 11 from a top wall 13 of the source reservoir. An air inlet 15 is located in top wall 13 of the source reservoir. A water outlet 18 from source reservoir 3, which functions as the system inlet, is located below upper water level W1, and may extend below a nominal floor 17 of the source reservoir. Where the source reservoir is a well, e.g. a water well, in the ground, system inlet 18 can be suspended in the water pool anywhere below the upper level W1 of the water. So long as column 34Q extends a sufficient distance below water level W1, inlet 18 can be at any elevation so long as there is sufficient liquid above inlet 18 to form a liquid seal between inlet 18 and any gaseous atmosphere above the liquid. Thus, the invention does not require any minimum depth between liquid level W1 and inlet 18 in order to be able to draw liquid from the source reservoir.

The depth of system inlet 18 in e.g. the ground can thus be any depth which ensures constant presence of the liquid at and above inlet 18 such that gas, such as air, does not enter the conduit at inlet 18. So long as gas does not enter the conduit at inlet 18, no restrictions generally need be imposed on the depth of the liquid over the inlet 18. The system inlet need not be associated with any source reservoir floor 17, and whereby no source reservoir floor need be established.

Destination reservoir 5 has a top wall 19 and a floor 21. An air inlet 23 is located in the top wall 19 of destination reservoir 5.

Each of cells A, B, and C has a top wall 25 and a floor 27, as well as respective upstanding walls between the respective top wall 25 and floor 27, thus to define a closed cell, having inlets and outlets as described herein. Specifically, cell A has a top wall 25A and a floor 27A. Cell B has a top wall 25B and a floor 27B. Cell C has a top wall 25C and floor 27C. In the embodiments illustrated in FIGS. 1–6, the floor of a given cell is in common with the top wall of the next vertically-adjacent cell. However, the floors and top walls of next-vertically adjacent cells can be separated from each other, or can overlap each other in terms of elevation, without departing from the scope of the invention. A water outlet 29 is located in the floor 27 of each cell. Thus, water outlet 29A is located in floor 27A of cell A. Water outlet 29B is located in floor 27B of cell B. Water outlet 29C is located in floor 27C of cell C. A water inlet 33 is located adjacent top wall 25 of each cell. Thus, water inlet 33A is located adjacent top wall 25A of cell A. Water inlet 33B is located adjacent top wall 25B of cell B. Water inlet 33C is located adjacent top wall 25C of cell C.

System inlet 18 and each cell liquid outlet 29 communicates with one of respective liquid-conveying conduits Q, R, S, and T. Each cell liquid inlet 33 and system outlet 65 also communicate with respective liquid-conveying conduits Q, R, S, T. Each of liquid-conveying conduits Q, R, S, T has a first column 34, second column 35, and junction element 36 connecting the lower extremities of conduit columns 34, 35. Specifically, a first liquid-conveying conduit Q extends between source reservoir 3 and cell A, and provides liquid communication for conveying the liquid in source reservoir 3 to cell A. Liquid-conveying conduit Q is configured as a U-shaped loop having a first downwardly-extending column 34Q, a second upwardly-extending column 35Q, and a laterally-extending junction element 36Q between the two columns 34Q, 35Q. Downwardly-extending column 34Q opens into the system inlet 18 which is the source reservoir outlet, in floor 17 of the source reservoir 3. Thus, system inlet 18 in the source floor represents a liquid inlet to liquid-conveying conduit Q, as well as being the system liquid inlet for liquid raising system 1. Upwardly-extending column 35Q of liquid-conveying conduit Q extends to a column outlet 33A adjacent top wall 25A of cell A, which operates as a cell A liquid inlet. First column 34Q of liquid-conveying conduit Q, excluding junction element 36Q, necessarily has a length, namely a water column height, H1 which is greater than the height H2 between water level W1 and liquid outlet 33A of second column 35Q. Second column 35Q therefore has a length equal to the sum of height H2 and water column height H1. System inlet 18 may optionally be placed at the base of column 35Q, whereby column 34Q is obviated, and whereby system inlet 18 is above the bottom of the reservoir.

Further, while source reservoir 3 is illustrated as a manufactured structure, the source reservoir can well be an e.g. naturally occurring geological reservoir into which inlet 18 of the liquid raising system is immersed.

Optimally for each respective downstream conduit R, S, T, columns 34R, 34S, 34T exclusive of respective junction elements 36R, 36S, 36T will be of a height H4 where column 34R, 34S, and 34T height H4 is greater than the height H3 from the respective outlets 29A, 29B, 29C of the upstream adjacent cell to the respective inlets 33B, 33C, of the downstream adjacent cells, and, in the case of column T, inlet 65 of destination reservoir 5. Likewise, for each respective downstream conduit R, S, T, columns 35R, 35S, 35T exclusive of respective junction elements 36R, 36S, 36T, have heights H5, equivalent to the sum of heights H3 and H4.

Specifically, the second liquid conduit R extends between cell A and cell B, and provides liquid communication for conveying the liquid in cell A from cell A to cell B. Liquid-conveying conduit R is configured as a U-shaped loop having a first downwardly-extending column 34R, a second upwardly-extending column 35R, and a laterally-extending extending junction element 36R between the two columns 34R, 35R. Downwardly-extending first column 34R of liquid-conveying conduit R has a liquid inlet at cell A liquid outlet 29A. Upwardly-extending second column 35R of liquid-conveying conduit R has a liquid outlet 33B opening into cell B, which operates as a cell B liquid inlet, adjacent top wall 25B of cell B.

And a third liquid conduit S extends between cell B and cell C, and provides liquid communication for conveying the liquid in cell B from cell B to cell C. Liquid-conveying conduit S is configured as a U-shaped loop having a first downwardly-extending column 34S, a second upwardly-extending column 35S, and a laterally-extending junction element 36S between the two columns 34S, 35S. Downwardly-extending first column 34S of liquid-conveying conduit S has a liquid inlet at cell B liquid outlet 29B. Upwardly-extending second column 35S of the liquid-conveying conduit S has a liquid outlet 33C opening into cell C which operates as a cell C liquid inlet, adjacent top wall 25C of cell C.

A fourth liquid conduit T extends between cell C and destination reservoir 5, and provides liquid communication for conveying the liquid in cell C from cell C to the system outlet in destination reservoir 5. Liquid-conveying conduit T is configured as a U-shaped loop having a first downwardly-extending column 34T, a second upwardly-extending column 35T, and a laterally-extending junction element 36T between the two columns 34T, 35T. Downwardly-extending first column 34T of liquid-conveying conduit T has a liquid inlet at cell C outlet 29C. Upwardly-extending second column 35T of the liquid-conveying conduit T has a liquid outlet 65 opening into destination reservoir 5, which operates as a destination reservoir inlet, adjacent top wall 19 of the destination reservoir.

Pressure-differential liquid raising system 1 further comprises a plurality of air conduits. In the embodiments illustrated in FIGS. 1–6, a first air conduit 67 is communicatively connected with air ports 15 and 23 of source reservoir 3 and destination reservoir 5, respectively. Air conduit 67 also connects with cell B by means of air port 69 adjacent top wall 25B. A second air conduit 71 connects with cell C by means of an air port 73 adjacent top wall 25C. Air conduit 71 also connects with cell A by means of an air port 75 adjacent top wall 25A of cell A.

Any one or all of source reservoir 3, destination reservoir 5, and cells A, B, and C can each have a separate air conduit connected to the corresponding air port in the reservoir or cell rather than having respective ones of the air ports share a common air conduit. The respective air ports can function as inlet ports and exhaust ports depending on the air handling operation in effect at a given time.

For this example, air conduits 67 and 71 are connected to each other by a valving arrangement, schematically shown at reference numeral 77, to a source of air pressure 79. Valving 77 includes a diverter schematically represented at reference numeral 81 for directing air flow to or from pressure source 79 to one or the other of air conduits 67 and 71.

Each of cells A, B, C, is substantially closed to casual flow of pressure, especially atmospheric pressure, and to casual flow of liquid, through the respective cell. For example, cell A represents a generally closed structure defined by floor 27A, top wall 25A, and upstanding side walls which connect and close the space between top wall 25A and floor 27A. Liquid outlet 29A is essentially filled up to floor 27A with water before system 1 is put into operation, and blocks passage of air at operating conditions. Column 35Q is filled with liquid up to approximately water level W1 of source reservoir 3 before system 1 is put into operation, and blocks passage of air at operating conditions. Air port 75 admits of ingress and egress of air through conduit 71, but only according to controlled pressure source 79, diverter 81, and the remaining similarly-closed cell C which is connected to air conduit 71, whereby cell C is substantially closed to casual gas and liquid flows. In this example, Cell B, and reservoirs 3 and 5, are correspondingly substantially closed receptacles, whereby each of cells A, B, and C are similarly substantially closed to casual ingress and egress flows of gas and liquid. In some embodiments, destination reservoir 5 is open to casual ingress and egress flows of gas and liquid, e.g. ambient air.

Figure 2:
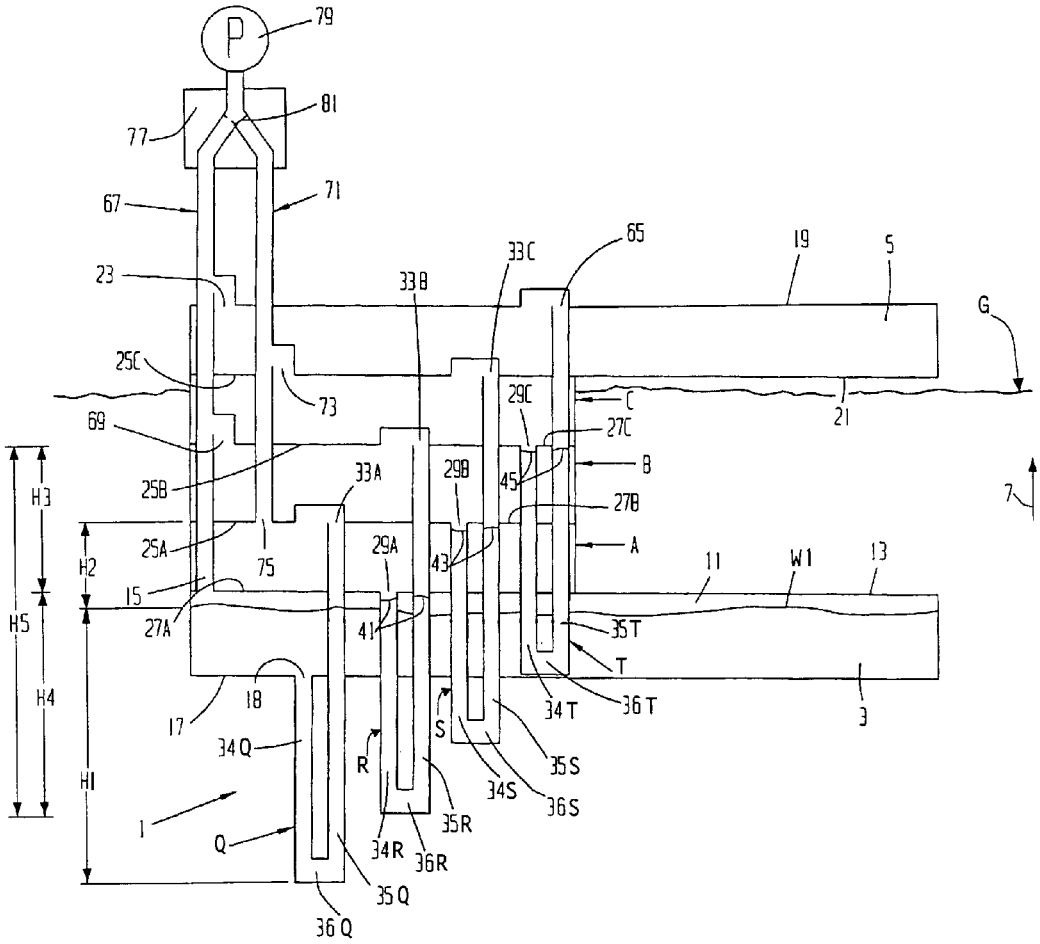
FIG. 2 is a diagram similar to FIG. 1, but showing the pressure-differential liquid raising system at a first stage of operation.

In operation, the pressure-differential liquid raising system 1 is initially primed as necessary to achieve the liquid conditions shown in FIG. 2. Namely, first column 34Q of liquid-conveying conduit Q is filled with the respective liquid, e.g. water. The second column 35Q of liquid-conveying conduit Q is filled with water to the upper water level W1 of the water in source reservoir 3. Both columns 34R and 35R of liquid-conveying conduit R are preferably each filled with water to a level 41 slightly below floor 27A of cell A. Columns 34S and 35S of liquid-conveying conduit S are preferably each filled to a level 43 slightly below floor 27B of cell B. Columns 34T and 35T of liquid conduit T are preferably each filled to a level 45 which is slightly lower than floor 27C of cell C. Prior to initiating operation of pressure-differential liquid raising system 1, no liquid need be in the liquid-receiving main chamber of any cell A, B, or C or in the liquid-receiving main destination reservoir 5. At that point, with no pressure-differential applied to the system through air conduits 67, 71, liquid raising system 1 is in both hydraulic balance and pneumatic balance, and no air or water flows within the system.

Figure 3:
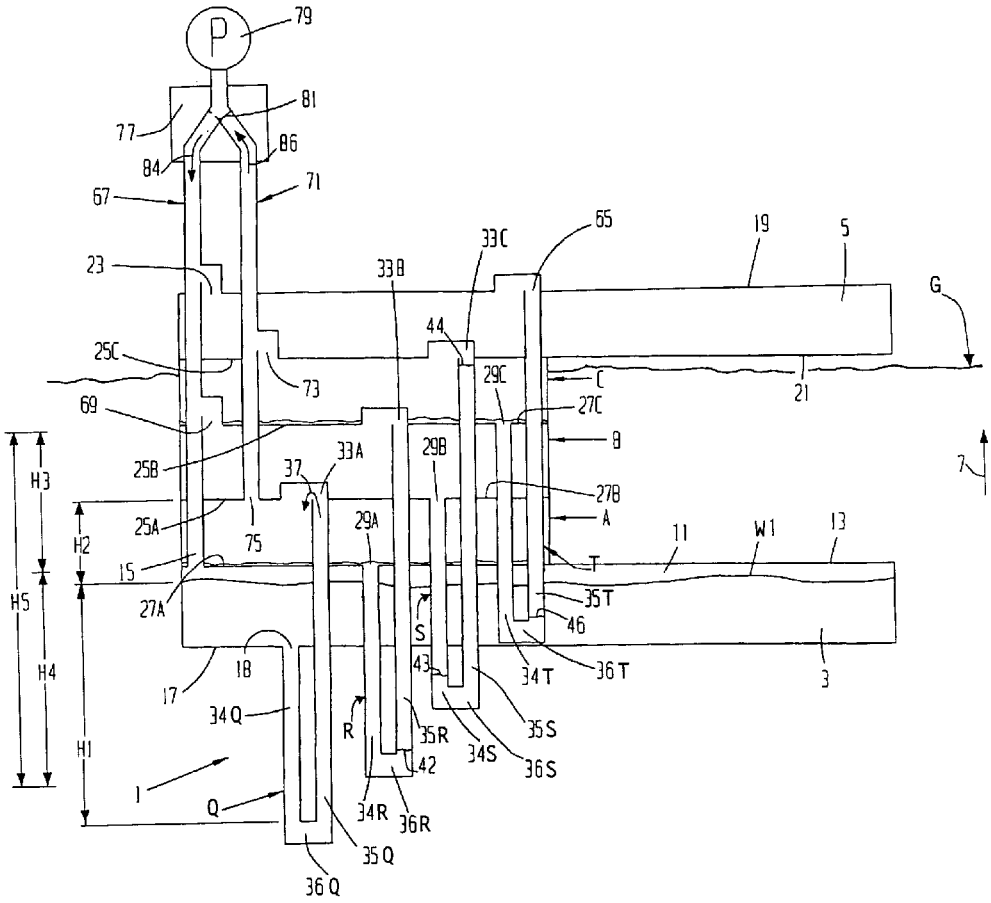
FIG. 3 is a diagram similar to FIG. 2, but showing the pressure-differential liquid raising system at a subsequent stage of operation.

Referring to FIG. 3, valving 77 is controlled to position diverter 81 to the position shown by the solid line, and pressure source 79 is activated. Air from pressure source 79 flows in the illustrated embodiment, as relatively positive air pressure, in the direction of arrow 84 in air conduit 67 to source reservoir 3, as well as to cell B and destination reservoir 5. The air in air conduit 71 flows in the direction of arrow 86 to an outlet (not shown) to atmosphere. The relative increase in pressure in air space 11 above upper surface W1 of the water in source reservoir 3 forces water in the source reservoir to flow out source outlet 18, through liquid conduit Q, and out of conduit Q at liquid outlet 33A. The water thus flows from the source reservoir into cell A as suggested by arrow 37. Similar air pressure acts on the water in columns 35R, 34S, and 35T to depress the liquid levels 42, 43, and 46 respectively, consequently raising liquid level 44 in column 35S, and causing water in columns 34R and 34T to backflow slightly into cells A and C respectively.

The critical air pressure differential required to raise the water from the source reservoir 3 to cell A is equal to about 0.43 pound per square inch gauge (psig) times the height H2 in feet, assuming the upper level W1 of the water does not fluctuate, and assuming standard atmospheric pressure. For other liquids, the pressure differential will be different. Thus, for a height H2 of ten feet, the air pressure in the air conduit 67 must be at least about 4.3 psig higher than the air pressure in conduit 71 for the water to reach liquid outlet 33A, and thus must have a greater than 4.3 psig difference for the water to flow from the source reservoir, through conduit Q and out outlet 33A, and into cell A.

Figure 4:
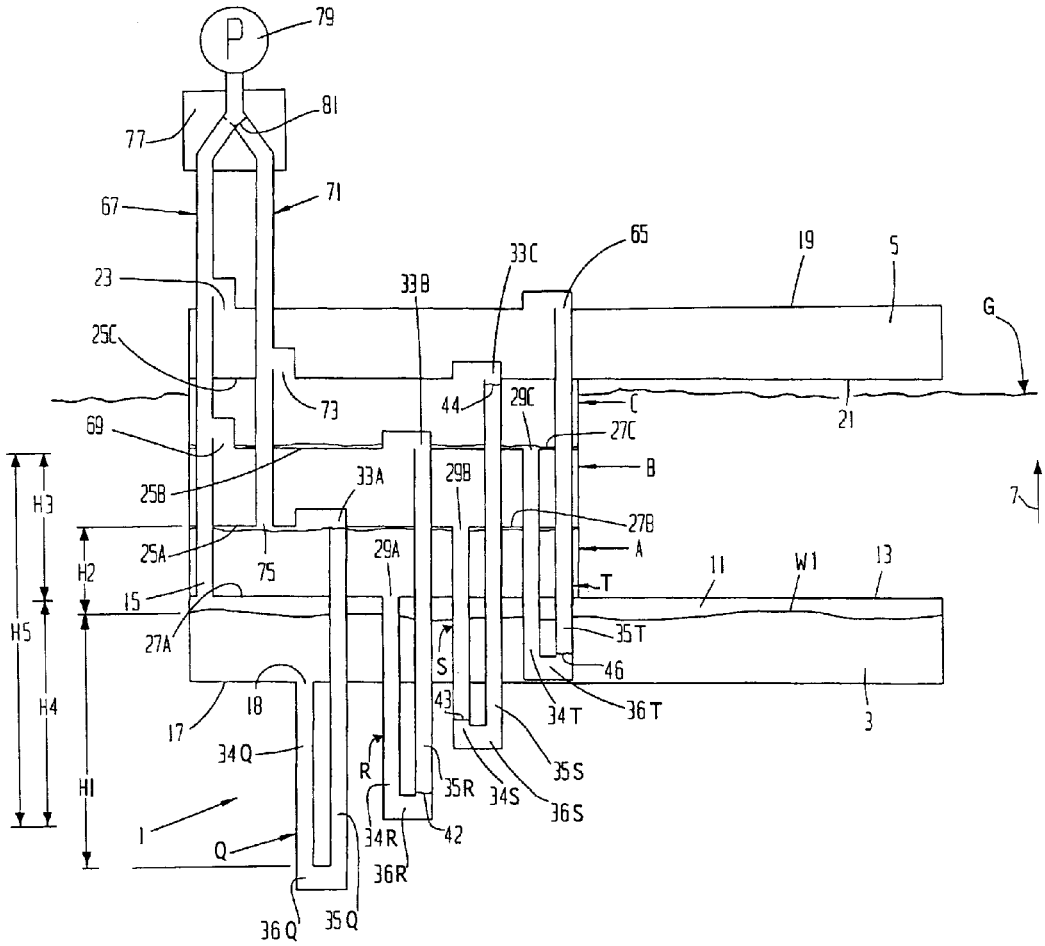
FIG. 4 is a diagram similar to FIG. 3, but showing the pressure-differential liquid raising system at a further stage of operation.

FIG. 4 assumes that filling cell A with water has just been completed. Given that cell A has just been filled with water, the entire column 35Q of liquid-conveying conduit Q is full of water. Valve 77 is then controlled to switch the diverter 81 to the position shown by the solid line in FIG. 5. Air in air conduit 67 vents in the direction of arrow 88 to an outlet (not shown) to the atmosphere, and relatively higher pressure air flows in the direction of arrow 87 in air conduit 71. The air in air conduit 71 enters air port 75 of cell A and forces the water in cell A out of the cell at outlet 29A, thus downwardly in column 34R, upwardly in column 35R and out of column 35R at outlet 33B, as illustrated by arrow 90. Cell B is thus filled from the water in cell A.

After an initial fraction of the water in cell A has flowed out of cell A, the relatively higher pressure air in conduit 71 enters liquid outlet 33A of column 35Q of liquid-conveying conduit Q, as illustrated by arrow 96A. The air pressure introduced through air conduit 71 further acts on the water in columns 34Q and 35Q, and junction element 36Q, forcing some of the water in liquid-conveying conduit Q to re-enter source reservoir 3 from column 34Q. The increased relative pressure from air conduit 71 thus depresses the level 89 of water in column 35Q.

Flow of liquid from a first cell, e.g. cell A, to a second cell, e.g. cell B, or from source reservoir 3 to a cell, or from a cell to destination reservoir 5, requires a critical minimum pressure differential between the respective cells, or cell and reservoir, greater than the liquid column pressure differential between the height of the outlet in e.g. the second cell and the top of the liquid in the first cell. Until the critical pressure differential is reached, no liquid flows from the first cell into the main receiving chamber of the second cell. The pressure differential is preferably greater than the critical pressure differential, thus to establish a substantial rate of flow of the liquid. The greater the pressure differential, the greater the rate of flow of the liquid.

The pressure differential applied between cell A and cell B also applies between cell A and the source reservoir. Accordingly, as the pressure increases in cell A relative to cell B and the source reservoir, the same pressure which causes the liquid to flow to cell B also pushes upstream on the liquid in conduit Q, urging the liquid therein toward the source reservoir. In the process, a nominal quantity of the liquid in conduit Q exits the conduit and thus enters the source reservoir.

Critically, the pressure differential is controlled such that the differential is not so great as to cause the pressurized air or other gas to blow through the respective conduit Q, R, S, T and into the next upstream cell, such that the liquid in each of the liquid conduits Q, R, S, T acts as a check-valve to the respective cell, or destination reservoir, preventing air or other gas from flowing upstream into the next cell or the source reservoir. Accordingly, for each liquid raising system of the invention, there is a pressure differential window within which the liquid check valves enable the system to effectively operate.

So long as the system is operated within the respective pressure differential window, the absolute pressures supplied by air conduits 67, 71 can vary within a wide range. Thus, where one of conduits 67, 71 is vented to the atmosphere, the pressure in the other of conduits 67, 71 is manipulated by a single pressure source 79, either as a positive or negative gauge pressure. Where an absolute pressure higher or lower than atmospheric pressure is used in both of air conduits 67, 71, each of conduits 67, 71 is connected to a separate pressure source, and the pressure sources are cooperatively manipulated/operated to generate a suitable pressure differential. In such case, diverter valve 81 is typically deleted in favor of having separate pressure control devices associated with each of the pressure sources, for separately providing and manipulating the desired pressure on a given one of air conduits 67, 71 at a given time. Where separate such pressure sources 79 and/or separate pressure control devices, are used, a system 1 of the invention preferably employs a system controller (not shown), such as a personal computer, or corresponding industrial computing control device such as a programmable logic controller (PLC), to control operations of the respective pressure sources and pressure control devices.

By the time cell A is emptied to cell B, water level 89 of water in column 35Q corresponds to water level W1 in source reservoir 3 in the same way that the final water level in column 34R of conduit R corresponds to the final water level at the top of column 35R, at opening 33B in cell B, equivalent to the pressure differential applied, expressed in terms of height of the liquid being raised.

So long as system 1 is operating within the pressure differential operating window compatible with the respective system, the system is always in hydraulic balance, and no air from cell A is able to enter the source reservoir through liquid-conveying conduit Q.

Figure 5:
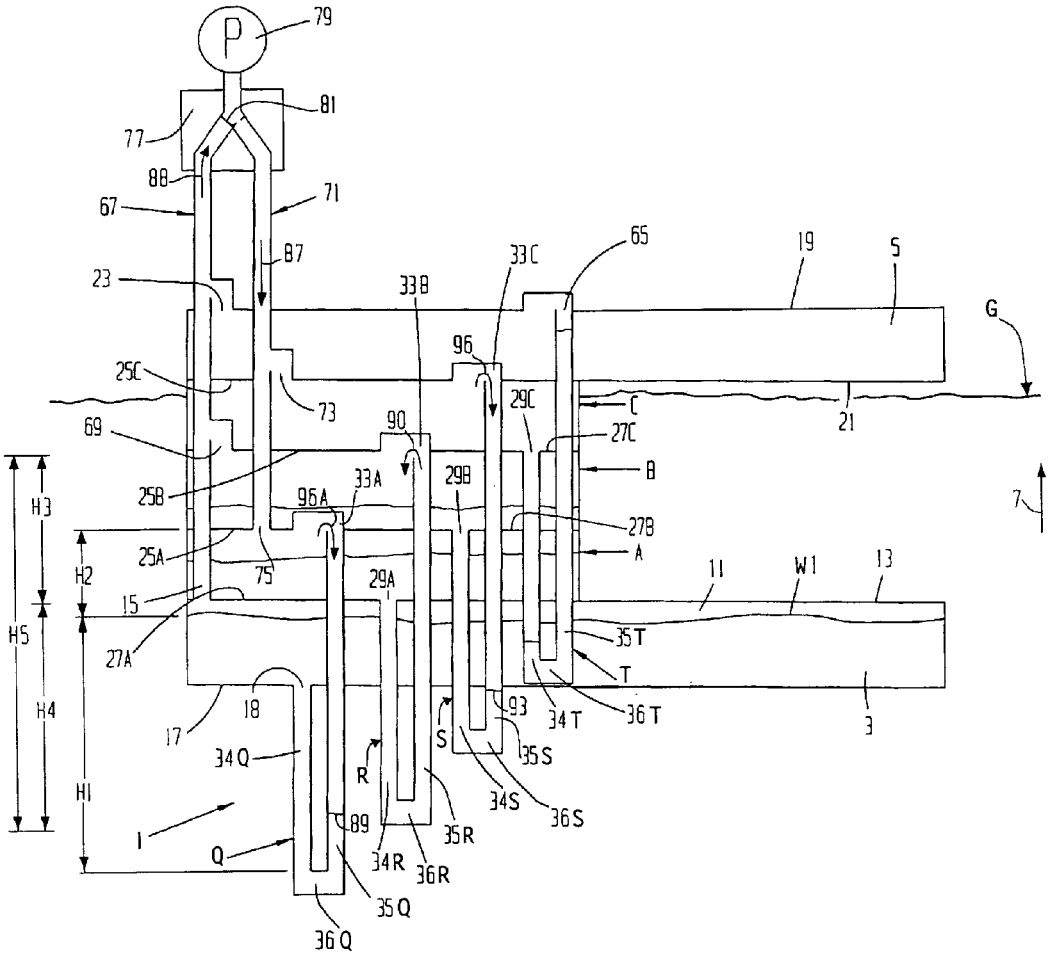
FIG. 5 is a diagram similar to FIG. 4, but showing a different stage of the operation of the present invention.

With the relatively higher air pressure in cell A as illustrated in FIG. 5, and with cells B and C still generally empty at start-up, the higher relative air pressure in cell C depresses the water levels in columns 35S and 34T as illustrated.

Figure 6:
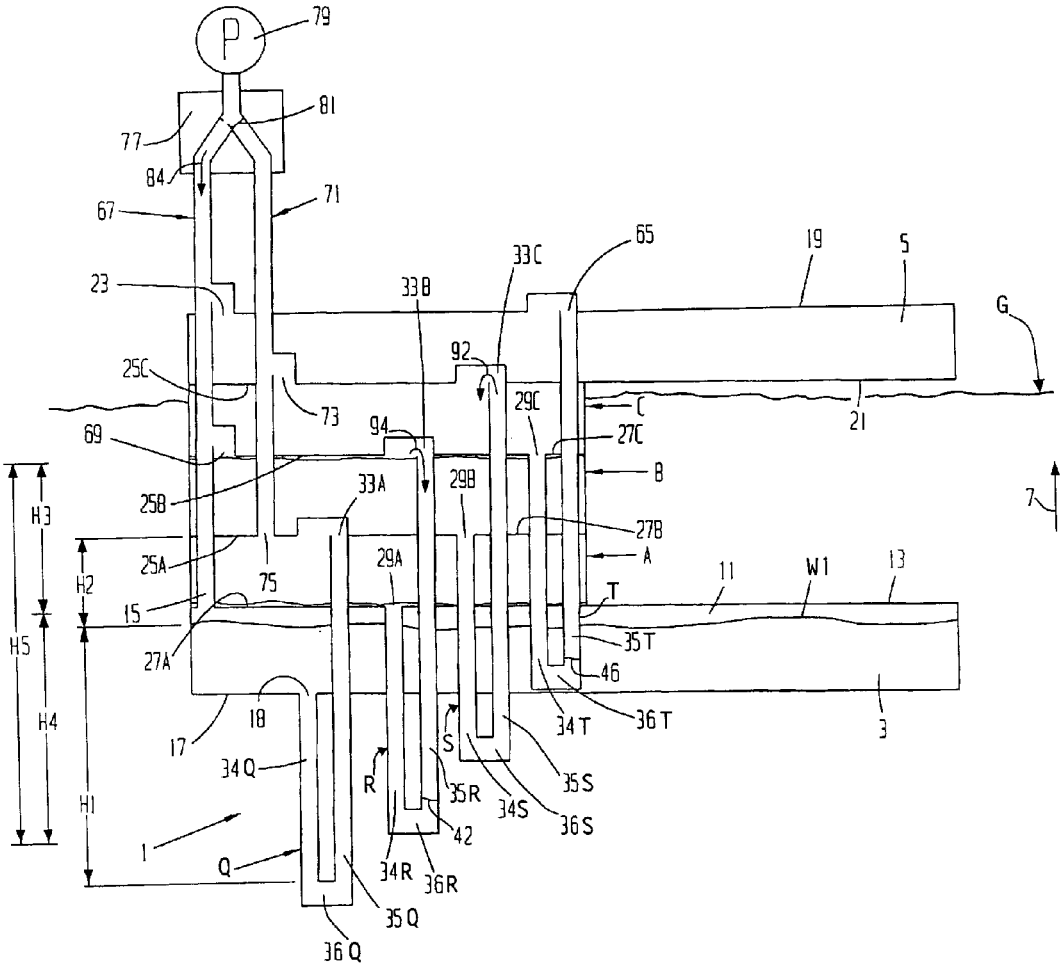
FIG. 6 is a diagram similar to FIG. 5, but showing another stage of the operation of the present invention.

When cell A is empty and cell B is full, the valve diverter is controlled to the position of the solid line 81 shown in FIG. 6. Relatively higher pressure air 84 in air conduit 67 enters cell B at air port 69. The air pressure forces water in cell B out of cell B through outlet 29B, through liquid conduit S, and out of conduit S at outlet 33C, as illustrated by arrow 92, thus filling cell C with the water which was in cell B. As soon as outlet 33B of column 35R in cell B is uncovered by the receding level of the water, the pressurized air from air conduit 67 enters column 35R, as illustrated by arrow 94. The air pressure in column 35R forces some of the water in column 34R back into cell A. The water level in column 35R stabilizes at approximately reference numeral 42 as cell B empties, rising from there as cell A again fills at approximately the same rate, from source reservoir 3 through conduit Q. As stated previously, system 1 is in hydraulic balance, whereby no air is able to flow backwards along the flow path, from cell B to cell A. As water is moving from cell B to cell C, an additional quantum of water is again flowing from source reservoir 3 into cell A. Further, the air pressure at 84 depresses the water level to reference numeral 46 in column 35T of conduit T similar to the depression of the water in column 35R of conduit R as illustrated.

When cell C has been filled with water, and correspondingly cell A has also been filled, alternatively when the next-upstream cell B has been emptied, valve diverter 81 is controlled to open the pressure to air conduit 71, as illustrated in FIG. 5. The air pressure 87 enters air ports 73 and 75 at cells A and C and forces water out through outlets 29A and 29C through liquid conduits R and T, out outlets 33B and 65, and into cell B and destination reservoir 5. The pressurized air enters outlet 33A in cell A and outlet 33C in cell C, as illustrated at arrows 96A and 96, respectively, and forces some water in liquid conduits Q and S back into source reservoir 3 and cell B. However, the water level in liquid conduits Q and S stabilizes at approximately reference numerals 89 and 93 in columns 35Q and 35S such that no air flows from cell C to cell B or from cell A to the source reservoir.

As suggested above, given the sharing in common of air conduits 67, 71, multiple cells are typically emptying and filling at any given time in system 1. In FIG. 5, water is concurrently emptying from cells A and C while correspondingly concurrently filling cell B and flowing into destination reservoir 5. Similarly, looking at FIGS. 3 and 6, water can typically be flowing from source reservoir 3 and cell B simultaneously to fill cell A and cell C, respectively. Thus, at any given point in time, two types of functions are occurring, wherein each cell can be identified with one of the two types of functions; cells which are emptying and cells which are filling.

Thus, once the liquid flow stream has reached the top cell, every cell is active when a pressure differential is being applied to the system through air conduits 67 and 71, in the sense that a given cell is either being filled or being emptied. Further, each cell cyclically, or alternately, repeats being filled and being emptied. The filling and emptying cycles are determined by the control exercised at valving 77. The result is that water is received at system inlet 18, e.g. from the source reservoir or other body of liquid, and is raised to the system outlet 65 where the water is discharged into the destination reservoir or other receiving structure, without requirement of any moving parts below diverter 81, and wherein diverter 81 and pressure source 79 can be at any elevation, though typically near or above the downstream-most cell.

System 1 can be thought of in terms of ground level "G", as an in-ground assembly and an above-ground assembly. The in-ground assembly is generally that equipment which is designed and configured to be installed below ground level, and is generally defined by the level of the ground at a typical installation. The above-ground assembly is that equipment which is typically designed and configured to be installed above ground level.

Referring to FIGS. 1–6, the in-ground assembly includes system inlet 18, conduit Q, cells A and B and their connecting conduits, and part of cell C, along with portions of air conduits 67 and 71. The above-ground assembly includes destination reservoir 5, pressure source 79, valving 77, diverter 81, part of cell C, and part of air pressure lines 67 and 71.

A major advantage of the invention is that the in-ground assembly is free from any moving parts, or any wear parts which require routine repair, replacement, or maintenance over the use life of the liquid raising system.

Since diverter 81 can be anywhere downstream of the pressure source, the diverter can be conveniently placed above ground level "G" in the above-ground assembly. Desirably, pressure source 79 is also part of the above-ground assembly and is placed at a location convenient for servicing. Thus, desirably, both pressure source 79 and diverter 81 are placed above ground level "G". Similarly, destination reservoir can be desirably placed above ground level "G". In the alternative, any or all of pressure source 79, diverter 81, and destination reservoir 5 can be placed conveniently below ground, with suitable access thereto as needed, for example to avoid ground level weather conditions. But so long as easy access is provided at or near ground level, or with easy access from ground level, for repair, replacement, or maintenance of parts which commonly need such servicing during the use life of the system, the respective component is considered to be part of the above-ground assembly.

From destination reservoir 5, the liquid can be discharged into a wide variety of receivers, for example a municipal or like water system, a tank, a truck, a shipping container, a chute, a sluice, a reservoir, a pond, a lake, a sea, an ocean, or the like. Further, the destination reservoir may itself be a removable tank or shipping container; thus eliminating the need to pump the liquid from the destination reservoir to a separate container.

Similarly, while the system inlet is illustrated in a reservoir of the liquid to be raised, all that is required is that the liquid be available to the system inlet under structural conditions which enable establishing the necessary pressure differential between the liquid, at the system inlet, and cell A, and that the conditions enable maintaining the necessary pressure differential for a time sufficient to move the desired quantity of liquid to cell A.

As described, the air conduits 67 and 71 are alternately supplied with relatively higher pressure air and vented to the atmosphere. The term relatively higher pressure air is meant to signify positive gauge air pressure, above ambient atmospheric air pressure. That is, the differential pressure which enables system 1 to work is the differential pressure between the pressure of air as suggested by arrow 87 in conduit 71, and atmospheric pressure; or between the pressure of air 85 in conduit 67 and atmospheric pressure.

It is an important aspect of the invention that the differential pressure need not be based on atmospheric pressure. Rather, the venting air 86 (FIG. 3) or 88 (FIG. 5) may be vented to a source of vacuum. In some cases, the relatively higher pressure air can be ambient atmospheric air pressure and the differential pressure is determined by the intensity of vacuum in air conduit 67 or 71. Any one of a number of methods can be used to establish pressure differential. In such methods, a "set" of cells means alternating cells, including source reservoir 3 and destination reservoir 5, to which a given level of absolute air pressure is exposed. Generally, a given liquid raising system of the invention comprehends 2 such sets of cells, namely cells which are being filled and cells which are emptying. Exemplary methods are:

1) applying vacuum, namely negative gauge air pressure, to the first set of cells while applying atmospheric pressure to the second set of cells;
2) applying positive gauge air pressure to the first set of cells, while leaving the second set at atmospheric pressure;

3) applying vacuum, namely negative gauge air pressure, to the first set of cells, and positive gauge air pressure to the second set of cells; or 4) applying alternating positive gauge air pressure and negative gauge air pressure, to the first set of cells while leaving the second set of cells at atmospheric pressure.

In FIGS. 1–6, cells A, B, and C are depicted in schematic form as being generally rectangular shaped containers, and with liquid conduits Q, R, S, T and air conduits 67 and 71 passing to and/or through the associated cells, source reservoir, and destination reservoir. In FIG. 7, a modified pressure-differential liquid raising system 95 having cells D, E, F, G, and H and air conduits 97, 99 is shown. The system 95 has representative liquid conduits 101 and 103 located outside of the cells D, E, F, G, and H. The air conduits 97 and 99 are also outside of the cells.

In some preferred embodiments, the system discharges at outlet 65 into ambient atmosphere wherein destination reservoir 5 is replaced by e.g. an open reservoir, an open container, an open trough, a canal, or the like. In such instances, pressure greater than atmospheric pressure is required to move the liquid from at least the final cell to the discharge at atmospheric pressure. In such instance, and where common openings as at 23 and 69, and at 73 and 75, are used for the given sets of cells, and since a positive gauge pressure is required to expel the liquid at outlet 65, a positive gauge pressure is required of pressure source 79; namely vacuum e.g. less than atmospheric pressure, cannot be used as the motive force.

Also in some preferred embodiments, column 34Q, and junction element 36Q, are omitted, whereby system inlet 18 is at the bottom of column 35Q. In such instance, height H1 between the bottom of column 35Q and upper level W1 of the liquid must be maintained.

FIG. 8 shows a system 105 which has two banks, bank I and bank J of cells; I1, I2, I3, I4, and I5, and J1, J2, J3, and J4, respectively. A respective liquid conduit, such as liquid conduit 107, has a liquid outlet 109 in a cell I3 in bank I, which leads to a liquid inlet 111 in cell J3 in bank J and at an elevation higher than the source cell I3, whereby liquid conduit 107 provides liquid communication between cells I3 and J3. The liquid thus passes back and forth between banks I and J from e.g. cell I1 to cell J1, from cell J1 to cell I2, from cell I2 to cell J2, from cell J2 to cell I3, and so on, to a destination reservoir or other discharge locus, not shown in FIG. 8.

Referring to e.g. FIGS. 1–6, the invention also comprehends composite liquid raising systems which comprise multiple cells A at a given common elevation, multiple cells B at a given common elevation, and the like, operating in parallel, optionally using common air conduits 67, 71 to raise liquid from a single source reservoir, or multiple source reservoirs, either to a common destination locus/reservoir or to separate destination loci/reservoirs. Similarly, multiple liquid raisings of the invention can be employed concurrently as a composite system to raise liquid from a single source reservoir, or multiple source reservoirs, either to a common destination locus/reservoir or to separate destination loci/reservoirs. Where either or both source reservoir or destination reservoir are employed in common, applications of pressure differential are necessarily coordinated within the composite system.

The versatility of the invention is further demonstrated with regard to FIGS. 9A–9E. In FIGS. 9A–9E, five variations 113A, 113B, 113C, 113D, and 113E are shown for the cells. As illustrated in FIGS. 9A–9E, the particular shape of the cell is not important. The only required criteria is that no portion of the liquid outlet 117, which feeds liquid from the liquid conduit into the cell, can be above any portion of air port 115. Also, liquid inlet 119, which feeds liquid from the cell into the liquid conduit leading to the next downstream cell, must be below liquid conduit outlet 117.

The invention has been described in the context of manipulating absolute air pressure in order to establish pressure differentials between respective ones of the cells, the source reservoir, and/or the destination reservoir. In some embodiments, one or more gaseous fluid, or mixture of fluids, other than air can be used in place of air, as the medium for establishing the pressure differentials.

As used herein, the phrase "vertically-adjacent" refers to elements of the system which are proximate each other in terms of elevation, though the respective elements may be displaced laterally from each other, there being no similar element having a closer match of elevations. The elevations to be so compared are the elevations, of the respective elements, which are most responsible for controlling the interactions of the elements with each other in causing the liquid to move.

Systems 1 of the invention provide a first major advantage in that the system can operate effectively with no moving parts positioned below the elevation of diverter 81, and diverter 81 can be positioned anywhere downstream of the pressure source. Since the pressure source is typically positioned above ground level "G", diverter 81 can be positioned above ground level "G" if desired.

Systems 1 of the invention provide a second major advantage in that such systems can raise liquid from depths greater than the depths available from conventional single stage pumps which operate on the basis of up to 1 atmosphere of vacuum lift. Thus, whereas single-stage vacuum-based water pumps, operating from atmospheric pressure, and assuming nominal pressure leakage through the pressure seals, are limited to e.g. about 30 feet of lift, vacuum-based liquid raising systems of the invention can lift water through a number of lift cells, also operating from atmospheric pressure. As a consequence, systems of the invention can lift water from much greater depths, through the plurality of lift cells. The number of lift cells which can be employed is theoretically unlimited. For a given well depth, the greater the number of cells, the lower the critical pressure differential in air conduits 67, 71. Thus, the design of a system 1 for e.g. raising water using atmospheric pressure as a raising pressure, against a vacuum draw, is driven first by the absolute minimum number of cells which must be used to raise the water from the depth of the reservoir, also referred herein as the source reservoir. Second, the design is driven by the available pressure differential. Thus, additional cells are specified as appropriate in order that the system operate within the available pressure differential.

Thus, where pressure source 79 is e.g. a mechanical pump driven by an internal combustion engine or an electric motor, or other mechanical device, a relatively higher, but still modest, pressure differential is typically developed, whereby a relatively lower number of cells are typically used. By contrast, where pressure source 79 is a manually operated vacuum pump, such as in a remote location, or in a poor community, where electricity is not dependable, or not available, or where an engine driven pump is not available, or where technical expertise to keep the pump running is not available, a relatively lower pressure differential is typically specified, whereby a relatively higher number of cells are typically specified and used. The number of cells specified, and the corresponding lowering of critical pressure differential, are balanced against the incremental capital cost of each additional cell.

A yet further advantage of systems of the invention is that the relatively low pressure differential, typically no greater than 1 standard atmosphere, enables use of relatively lower levels of technology, including relatively lower cost pressure source, and relatively lower cost seals and valving, whereby the cost of the system can be correspondingly controlled.

As suggested above, systems 1 of the invention can be operated on very modest pressure differential, dependent generally on the height of the respective cells above each other. Accordingly, liquid raising systems of the invention can be employed, using human energy alone, to provide water to poor and rural communities even though power infrastructure is unavailable, and even though water is only available below the lift height of single stage lift pumps.

Those skilled in the art will now see that certain modifications can be made to the apparatus and methods herein disclosed with respect to the illustrated embodiments, without departing from the spirit of the instant invention. And while the invention has been described above with respect to the preferred embodiments, it will be understood that the invention is adapted to numerous rearrangements, modifications, and alterations, and all such arrangements, modifications, and alterations are intended to be within the scope of the appended claims.

To the extent the following claims use means plus function language, it is not meant to include there, or in the instant specification, anything not structurally equivalent to what is shown in the embodiments disclosed in the specification.

Having thus described the invention, what is claimed is:

1. A pressure-differential liquid raising system, comprising:

(a) a system inlet at a first elevation for receiving liquid;

(b) a system outlet at a second elevation higher than the first elevation;

(c) at least one cell at a third intermediate elevation between the first and second elevations, said at least one cell having a cell liquid inlet and a cell liquid outlet;

(d) a first liquid-conveying conduit having a first conduit liquid inlet in common with the system inlet at the first elevation, and a first conduit liquid outlet in a respective first said cell at a third elevation, corresponding to a first liquid inlet of the respective first said cell, said third elevation being higher than the first elevation of the first conduit liquid inlet;

(e) a second liquid-conveying conduit having a second conduit liquid inlet in common with a second liquid outlet of the respective first said cell, and a second conduit liquid outlet at a higher fourth elevation than the second conduit liquid inlet; and (f) pressure differential apparatus adapted to supply a first pressure differential between the system inlet and the respective first said cell, thereby to cause liquid at the system inlet to flow through the first liquid-conveying conduit to the respective first said cell, said pressure differential apparatus being further adapted to apply a second different pressure differential between the first said cell and one of a downstream said cell and the system outlet, and to simultaneously apply the second pressure differential between the first said cell and the system inlet thereby to cause liquid from the respective first said cell to flow in the downstream direction through the second liquid-conveying conduit along a liquid flow path toward the system outlet as well as to cause a nominal amount of the liquid to flow from the first said cell upstream toward said system inlet.

2. A pressure-differential liquid raising system as in claim 1 wherein liquid is raised from a source reservoir at said system inlet and flows in a downstream direction through the respective first said cell in response to cyclically applying the first and second pressure differentials.

3. A pressure-differential liquid raising system as in claim 1 wherein the first liquid-conveying conduit comprises first and second liquid-conveying columns in liquid communication with each other and which collectively define a liquid flow path, and wherein a portion of the liquid flow path is disposed at a lower elevation than the system inlet.

4. A pressure-differential liquid raising system as in claim 1, further comprising multiple substantially closed vertically-adjacent upstream and downstream cells at respective intermediate elevations between the system inlet and the system outlet, and corresponding multiple liquid-conveying conduits between vertically-adjacent upstream and downstream said cells, each of the corresponding multiple said liquid-conveying conduits having a liquid inlet in the respective vertically-adjacent upstream cell and a liquid outlet in the respective vertically-adjacent downstream cell.

5. A pressure-differential liquid raising system as in claim 1, further comprising a source reservoir, the source reservoir being substantially closed to casual ambient air-pressure.

6. A pressure-differential liquid raising system as in claim 3 wherein the liquid flow path extends downwardly from the system inlet along the first column, and upwardly along the second column to the first liquid outlet.

7. A pressure-differential liquid raising system as in claim 1, further comprising a destination reservoir for receiving liquid from the system outlet, wherein the destination reservoir is substantially closed to casual ambient air pressure.

8. A pressure-differential liquid raising system as in claim 1 wherein the first and second liquid-conveying conduits are free from structure which would substantially impede flow of liquid therein.

9. A pressure-differential liquid raising system as in claim 1 wherein the first and second liquid-conveying conduits are free from structure which would stop flow of liquid therein.

10. A pressure-differential liquid raising system as in claim 2 wherein the liquid in the second liquid-conveying column of the first liquid-conveying conduit is at a lower elevation than the liquid in the first liquid-conveying column of the first liquid-conveying conduit in response to applying the second pressure differential to the respective said cell, but wherein the liquid in the first liquid-conveying conduit prevents air in the respective said cell from passing upstream in the liquid flow path beyond the first liquid-conveying conduit.

11. A pressure-differential liquid raising system as in claim 1, said liquid raising system comprising an in-ground assembly for installation below ground level "G", said in-ground assembly being free from moving parts and parts which require routine repair or maintenance.

12. A pressure-differential liquid raising system as in claim 1, installed in the ground and reaching into an underground source reservoir of liquid, wherein the underground source reservoir is defined by underground geological structure.

13. A pressure-differential liquid raising system, for moving liquid, from a first elevation, to a second elevation higher than the first elevation, said system comprising:

(a) a system inlet at the first elevation, for receiving liquid, into the system;

(b) a system outlet at the second elevation;

(c) at least one cell between the system inlet and the system outlet;

(d) a first liquid-conveying conduit having a first conduit liquid inlet in common with the system inlet, and a first conduit liquid outlet in a respective first said cell at a first elevation, and first and second liquid-conveying columns, portions of each of said first and second liquid-conveying columns being at lower elevations than the system inlet;

(e) a second liquid-conveying conduit having a second conduit liquid inlet in common with a first liquid outlet of the respective first said cell, and a second conduit liquid outlet above a floor of the respective first said cell; and (f) pressure differential apparatus adapted to supply pressure differentials between the system inlet and the respective first said cell, thereby to cause liquid at the system inlet to flow in a downstream direction from the system inlet through the first liquid-conveying conduit to the respective first said cell, and to cause the liquid to flow in the downstream direction from the respective said cell.

14. A pressure-differential liquid raising system as in claim 13, said pressure-differential liquid raising system being adapted to cyclically apply a second pressure differential between the respective said one of a downstream said cell and the system outlet.

15. A pressure-differential liquid raising system as in claim 13 wherein at least one of the first and second liquid-conveying conduits is free from structure which would substantially restrict flow of liquid in the respective said liquid-conveying conduit.

16. A pressure-differential liquid raising system as in claim 13 wherein at least one of the first and second liquid-conveying conduits is free from structure which would stop flow of liquid in the respective said liquid-conveying conduit.

17. A pressure-differential liquid raising system as in claim 13, further comprising a destination reservoir, and wherein the destination reservoir is a substantially closed container.

18. A pressure-differential liquid raising system as in claim 13 wherein the first liquid-conveying conduit comprises first and second columns in liquid communication with each other and which collectively define a liquid-conveyance path, and wherein the liquid is at first and second different elevations in the first and second columns in response to applying the second pressure differential to the respective said cell.

19. A pressure-differential liquid raising system as in claim 13, further comprising multiple vertically-adjacent upstream and downstream cells in liquid communication with each other at respective elevations, each being between the first and second elevations, and an intermediate liquid-conveying conduit between each respective pair of vertically-adjacent cells, each liquid-conveying conduit having a cell inlet in the respective said upstream cell and a cell outlet in the respective said downstream cell.

20. A pressure-differential liquid raising system as in claim 13, installed in the ground and reaching into an underground source reservoir of liquid, wherein the underground source reservoir is defined by underground geological structure.

21. A pressure-differential liquid raising system, for moving liquid, from a first elevation, to a second elevation higher than the first elevation, said system comprising:

(a) a system inlet at the first elevation, for receiving liquid into the system;

(b) a system outlet at the second elevation;

(c) at least one cell between the system inlet and the system outlet;

(d) a liquid-conveying conduit having a first conduit liquid inlet in common with a first liquid outlet of a first said cell inlet, and a first conduit liquid outlet in a respective second said cell at a first elevation, and first and second liquid-conveying columns, portions of each of said first and second liquid-conveying columns being at lower elevations than the first liquid conduit inlet;

(e) a second liquid-conveying conduit having a second conduit liquid inlet in common with a second liquid outlet of the respective second said cell, and a second conduit liquid outlet above a floor of the respective second said cell; and (f) pressure differential apparatus adapted to supply pressure differentials between the first said cell and the respective second said cell.

22. A pressure-differential liquid raising system as in claim 21, said pressure-differential liquid raising system being adapted to cyclically apply a second pressure differential between the respective said one of a downstream said cell and the system outlet.

23. A pressure-differential liquid raising system as in claim 21, said pressure differential liquid raising system being adapted to cyclically apply a first pressure differential between the respective said one of a downstream said cell and the system outlet, thereby to cause the liquid to flow in the downstream direction from the respective said cell.

24. A pressure-differential liquid raising system as in claim 21 wherein at least one of the first and second liquid-conveying conduits is free from structure which would substantially restrict flow of liquid in the respective said liquid-conveying conduit.

25. A pressure-differential liquid raising system as in claim 21 wherein at least one of the first and second liquid-conveying conduits is free from structure which would stop flow of liquid in the respective said liquid-conveying conduit.

26. A pressure-differential liquid raising system as in claim 21, further comprising a destination reservoir, and wherein the destination reservoir is a substantially closed container.

27. A pressure-differential liquid raising system as in claim 21 wherein the first liquid-conveying conduit comprises first and second columns in liquid communication with each other and which collectively define a liquid-conveyance path, and wherein the liquid is at first and second different elevations in the first and second columns in response to applying the second pressure differential to the respective said cell.

28. A pressure-differential liquid raising system as in claim 21, further comprising multiple vertically-adjacent upstream and downstream cells in liquid communication with each other at respective elevations, each being between the first and second elevations, and an intermediate liquid-conveying conduit between each respective pair of vertically-adjacent cells, each liquid-conveying conduit having a cell inlet in the respective said upstream cell and a cell outlet in the respective said downstream cell.

29. A pressure-differential liquid raising system as in claim 21, installed in the ground and reaching into an underground source reservoir of liquid, wherein the underground source reservoir is defined by underground geological structure.

30. A pressure differential liquid raising system, comprising:

(a) a system inlet at a first elevation for receiving liquid;

(b) a system outlet at a second elevation higher than the first elevation;

(c) a plurality of cells at intermediate elevations between the first and second elevations, each said cell having a top wall, a floor, a cell liquid inlet, a cell liquid outlet, and a gas port;

(d) liquid-conveying conduits connecting next vertically adjacent ones of said cells to each other at conduit liquid inlets at upstream ones of said adjacent cells and conduit outlets at the relatively downstream ones of said cells, each said liquid-conveying conduit having a downwardly extending column at an upstream end of said conduit, extending downwardly to an elevation below the floor of the respective said cell whereby a portion of the respective said liquid-conveying conduit is at an elevation lower than the lowest component of the respective said cell; and (e) pressure differential apparatus adapted to supply pressure differentials between respective ones of said cells.

31. A pressure differential liquid raising system as in claim 30 wherein a height of the portion of a respective said conduit which is below the floor of the respective said cell is greater than a height from the cell liquid inlet to the top wall of the next adjacent downstream cell.

32. A pressure differential liquid raising system as in claim 30 wherein a height of the portion of a respective said conduit which is below the floor of the respective said cell is greater than the height between the floor of the respective said cell and the top wall of the next vertically-adjacent said cell.

33. A pressure differential liquid raising system as in claim 30 wherein said system is free from parts requiring routine repair or maintenance below at least one of the pressure differential apparatus and a destination reservoir.

34. A pressure-differential liquid raising system as in claim 30, installed in the ground and reaching into an underground source reservoir of liquid, wherein the underground source reservoir is defined by underground geological structure.

35. A pressure differential liquid raising system, for moving liquid, comprising:

(a) an in-ground assembly comprising (i) a system inlet, (ii) at least one in-ground cell, having a top wall, and a floor, and (iii) liquid-conveying conduits adapted to convey the liquid to and through said at least one in-ground cell; and (b) an above ground assembly connected to the in-ground assembly, said above-ground assembly comprising (iv) a system outlet at a destination reservoir adapted to receive liquid raised through said at least one cell, (v) a pressure differential source, and (vi) pressure control apparatus for cycling the pressure differential between the respective said cells, between a most downstream one of said cells and said destination reservoir, and between a most upstream one of said cells and a source reservoir, said in-ground assembly being free from parts which routinely require repair or maintenance.

36. A pressure differential liquid raising system as in claim 35 wherein a respective said liquid-conveying conduit conveying liquid from a respective said cell comprises a liquid flow path disposed at lower elevations than the floor of the respective said cell.

37. A pressure differential liquid raising system as in claim 35, said in-ground assembly further comprising multiple vertically-adjacent upstream and downstream ones of said cells, and corresponding multiple said liquid-conveying conduits between vertically adjacent upstream and downstream ones of said cells each of the corresponding multiple said liquid-conveying conduits having a liquid inlet in the respective vertically-adjacent upstream cell and a liquid outlet in the respective vertically-adjacent downstream cell.

38. A pressure differential liquid raising system as in claim 35 wherein the first and second liquid-conveying conduits in the in-ground assembly are free from structure which would substantially impede flow of liquid therein.

39. A pressure differential liquid raising system as in claim 35 wherein the first and second liquid-conveying conduits in the in-ground assembly are free from structure which would stop flow of liquid therein.

40. A pressure-differential liquid raising system as in claim 35, installed in the ground and reaching into an underground source reservoir of liquid, wherein the underground source reservoir is defined by underground geological structure.

41. A method of raising liquid from a system inlet at a first elevation to a system outlet at a second elevation higher than the first elevation, the method comprising:

(a) providing at least one cell at an intermediate elevation between the first and second elevations;

(b) applying a first pressure differential between one of (i) the system inlet and a first one of the respective cells, (ii) first and second ones of the cells, and (iii) one of the cells and the system outlet, and thereby causing the liquid to flow downwardly from the respective one of the system inlet and a respective one of the cells in a downstream direction to a third elevation lower than the first elevation, and subsequently causing the liquid to flow in the downstream direction and upwardly and to the respective first one of the cells, the second one of the cells, and the system outlet; and (c) applying a second pressure differential between the respective cell and one of a second said cell and said system outlet and thereby causing the liquid to flow from the respective cell in the downstream direction and toward the system outlet at the second elevation.

42. A method as in claim 41 wherein causing the liquid to flow into the respective cell at a fourth elevation, and wherein causing the liquid to flow from the respective cell comprises causing the liquid to flow from the respective said cell at a fifth elevation lower than the fourth elevation.

43. A method as in claim 41, further comprising conveying the liquid through a sufficient number of cells, at sufficient pressure differential between the cells, to lift the liquid at least 40 feet in elevation.

44. A method as in claim 41, further comprising conveying the liquid through a sufficient number of cells, at sufficient pressure differential between the cells, to lift the liquid at least 70 feet in elevation.

45. A method as in claim 41, further comprising conveying the liquid through a sufficient number of cells, at sufficient pressure differential between the cells, to lift the liquid at least 100 feet in elevation.

46. A method as in claim 41, further comprising drawing liquid into the system at the system inlet from an underground source reservoir defined by underground geological structure.

47. A method of raising liquid from a system inlet at a first elevation to a system outlet at a second elevation higher than the first elevation, the method comprising:

(a) providing an in-ground assembly comprising
  (i) a system inlet,
  (ii) at least one in-ground cell, having a top wall and a floor, and
  (iii) liquid-conveying conduits adapted to convey the liquid to and through the at least one in-ground cell;

(b) providing an above-ground assembly connected to the in-ground assembly, the above-ground assembly comprising
  (iv) a system outlet at a destination reservoir adapted to receive liquid raised through the cells,
  (v) a pressure differential source, and
  (vi) pressure control apparatus; and (c) applying cyclic sequential pressure differentials to the in-ground assembly thus to cause liquid to flow from the system inlet to the system outlet without use, in the in-ground assembly, of parts which require routine repair or maintenance.

48. A method as in claim 47, including causing liquid to flow, from a respective cell downwardly below the floor of the cell and thence upwardly to a next vertically-adjacent cell.

49. A method as in claim 48 wherein the height of the downward flow is sufficiently great to prevent back flow of air into the respective cell, from the next vertically-adjacent downstream cell when the pressure differential is reversed, and wherein the pressure differential is no greater than standard atmospheric pressure.

50. A method as in claim 47, further comprising conveying the liquid through a sufficient number of cells, at sufficient pressure differential between the cells, to lift the liquid at least 40 feet in elevation.

51. A method as in claim 47, further comprising conveying the liquid through a sufficient number of cells, at sufficient pressure differential between the cells, to lift the liquid at least 70 feet in elevation.

52. A method as in claim 47, further comprising conveying the liquid through a sufficient number of cells, at sufficient pressure differential between the cells, to lift the liquid at least 100 feet in elevation.

53. A method as in claim 47 wherein the in-ground assembly is free from moving parts.

54. A method as in claim 47, further comprising drawing liquid into the system at the system inlet from an underground source reservoir defined by underground geological structure.

* * * * *